US008534945B2

(12) United States Patent
Muhr-Sweeney

(10) Patent No.: US 8,534,945 B2
(45) **Date of Patent: *Sep. 17, 2013**

(54) DUAL CLEANING APPARATUS

(76) Inventor: Audrey Muhr-Sweeney, Huntington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/351,984

(22) Filed: Jan. 17, 2012

(65) Prior Publication Data

US 2012/0207530 A1 Aug. 16, 2012

Related U.S. Application Data

(63) Continuation of application No. 12/471,912, filed on May 26, 2009, now abandoned, which is a continuation of application No. 10/924,698, filed on Aug. 24, 2004, now Pat. No. 7,553,100, which is a continuation-in-part of application No. 10/383,375, filed on Mar. 7, 2003, now abandoned.

(60) Provisional application No. 60/438,871, filed on Jan. 9, 2003.

(51) Int. Cl.
*B43K 27/04* (2006.01)

(52) U.S. Cl.
USPC ..... 401/34; 15/104.94; 401/23; 401/17

(58) Field of Classification Search
USPC ..... 401/17–19, 23–24, 29–35, 95, 99, 401/117, 195, 230, 132–135, 196–207, 268–288; 604/1, 3
See application file for complete search history.

(56) References Cited

U.S. PATENT DOCUMENTS

| | | | | |
|---|---|---|---|---|
| 2,315,996 | A * | 4/1943 | Workman | 401/186 |
| 3,288,116 | A * | 11/1966 | Poritz | 401/29 |
| 3,341,884 | A * | 9/1967 | Pryor | 401/17 |
| 4,557,618 | A * | 12/1985 | Iwata et al. | 401/34 |
| 4,726,700 | A * | 2/1988 | Gray | 401/183 |
| 4,963,046 | A * | 10/1990 | Eguchi | 401/160 |
| 5,762,077 | A * | 6/1998 | Griffiths, Jr. | 132/74.5 |
| 5,765,407 | A | 6/1998 | Choo et al. | |
| 5,895,160 | A * | 4/1999 | Ginelli | 401/17 |
| 5,993,097 | A | 11/1999 | DeBaene | |
| 6,049,934 | A * | 4/2000 | Discko | 15/106 |
| 6,074,705 | A | 6/2000 | DeBaene | |
| 6,152,643 | A * | 11/2000 | Miller | 403/307 |
| 6,357,943 | B1 * | 3/2002 | Kuang | 401/17 |
| 6,428,230 | B2 * | 8/2002 | Rodgers | 401/17 |
| 6,644,879 | B2 | 11/2003 | Irvin et al. | |
| 6,789,971 | B2 * | 9/2004 | Tsaur | 401/133 |
| 6,832,867 | B2 | 12/2004 | Sandbach et al. | |

(Continued)

*Primary Examiner* — David Walczak
*Assistant Examiner* — Jennifer C Chiang
(74) *Attorney, Agent, or Firm* — Edward C. Meagher; Carterm DeLuca, Farrell & Schmidt, LLP

(57) ABSTRACT

A cleaning apparatus providing a user with the ability to perform two cleaning functions with the same apparatus is disclosed. According to one aspect of the present disclosure the cleaning apparatus includes an elongated body portion having first and second ends, a first tip integral with the first operative end, the first tip including a first solution for performing a first cleaning function on the electronic equipment, and a second tip integral with the second operative end, the second tip including a second solution to the second operative end for performing a second cleaning function on the electronic equipment.

13 Claims, 8 Drawing Sheets

(56) References Cited

U.S. PATENT DOCUMENTS

| | | | | |
|---|---|---|---|---|
| 6,838,423 | B2 | 1/2005 | Irvin et al. | |
| 6,846,332 | B2 | 1/2005 | Boissie et al. | |
| 7,001,093 | B2 * | 2/2006 | Rosso | 401/131 |
| 7,596,974 | B2 | 10/2009 | Smith et al. | |
| 7,743,443 | B2 | 6/2010 | Wick et al. | |
| 7,832,041 | B2 | 11/2010 | Smith et al. | |
| 2004/0105716 | A1 * | 6/2004 | Carlino | 401/19 |

* cited by examiner

DUAL CLEANING APPARATUS

CROSS-REFERENCE TO RELATED APPLICATIONS

The present application is a continuation of U.S. patent application Ser. No. 12/471,912 filed on May 26, 2009, which is a continuation of U.S. patent application Ser. No. 10/924,698 filed on Aug. 24, 2004, which is a continuation-in-part of U.S. application Ser. No. 10/383,375 filed on Mar. 7, 2003, which claims the benefits of and priority to U.S. Provisional Patent Application Ser. No. 60/438,871 filed on Jan. 9, 2003, the entire contents of all of which are incorporated herein by reference.

BACKGROUND

1. Technical Field

The present disclosure relates to a cleaning apparatus designed to clean a wide array of electronic devices, and more particularly, to a cleaning apparatus having two cleaning functions designed to clean the internal and external components of electronic equipment, such as, for example, sensors, rollers, print heads, platens, etc.

2. Background of Related Art

Heretofore, an alcohol-based solution (e.g., isopropyl alcohol) has been used with some success to clean the rollers and reading, writing or scan heads (hereinafter "r/w/s heads) of printers, facsimile machines, copiers, photo and optic sensors, chips, internal optics, smart card readers, smart chips, bar code encoders and decoders, magnetic readers, scanners and/or the like. However, it is known that while alcohol-based solutions have some success in cleaning the above-mentioned devices, alcohol-based solutions can detrimentally affect the life of the more sensitive, internal working components of these devices. For example, repeated cleaning with alcohol-based solutions can affect the elasticity of the feed or follower rollers/bars and/or r/w/s heads.

Accordingly, it should be apparent that different components within the same electronic device require different cleaning solutions or different cleaning solution applicators for effective cleaning. For example, while the thermal printer head on a label printer generally requires an alcohol-based solution as a cleaning solution and an angled or slanted applicator in order to effect proper cleaning thereof, the roller and platens of the label printer generally require a non-alcohol-based rubber rejuvenator solution and a flat applicator for effective cleaning.

The use of a cleaning instrument having a single-shaped applicator on one end thereof and including a single cleaning solution is well known. A drawback to such a cleaning instrument is that the instrument is limited to the cleaning of a specific component of the electronic device and is limited to providing a single cleaning solution. Accordingly, such a cleaning instrument is ineffective in cleaning other components of the electronic devices in which clean components are crucial to the efficient operation of the electronic device. As such, at least one additional and separate cleaning instrument including a second applicator and a second cleaning solution is required.

Certain components of electronic devices require more than one cleaning function or step. For example, in order to properly clean a label printer having adhesive residue stuck on the printer head a user must first remove the adhesive residue from the printer head by using a first instrument (e.g., a wiper) to apply a first solution (e.g., an adhesive-removing solution) to the printer head and then by using a second instrument (e.g., a scraper) to remove the emulsified adhesive from the printer head. Following this step, the user needs to clean the first solution off of the printer head by using a third instrument (e.g., a wiper or swab) containing an amount of a second solution (e.g., isopropyl alcohol) to wipe the second solution onto the printer head. As is evident, multiple instruments are thus required to accomplish one overall cleaning function.

Accordingly, there exists a need for a new, simple, yet effective cleaning apparatus which can accomplish multiple cleaning functions (e.g., cleaning and removing contaminants from different types of components of electronic devices) in a single apparatus.

SUMMARY

The present disclosure relates to a cleaning apparatus providing a user with the ability to perform two cleaning functions with the same apparatus. According to one aspect of the present disclosure the cleaning apparatus includes an elongated body portion having first and second ends, a first tip integral with the first operative end, the first tip including a first solution for performing a first cleaning function on the electronic equipment, and a second tip integral with the second operative end, the second tip including a second solution to the second operative end for performing a second cleaning function on the electronic equipment.

It is envisioned that the elongated body portion is hollow and defines a pair of first and second reservoirs, the first reservoir is disposed in fluid connection with the first tip and the second reservoir is disposed in fluid communication with the second tip. It is contemplated that the elongated body portion includes at least one port formed therein, which port(s) is accessible to a respective one of the first and second reservoirs.

It is contemplated that the first reservoir contains the first solution and the second reservoir contains the second solution. Preferably, at least one of the first and second solutions is communicated to a respective first and second tip in a wick-like fashion.

It is envisioned that the first solution is an alcohol-based solution while the second solution is a non-alcohol-based solution. Preferably, the first solution is isopropyl alcohol and the second solution is a citric-based solution.

It is envisioned that at least one of the first and second tips is an abrasive structure. Preferably, at least one of the first and second tips is a coarse felt, course cellulose, coarse paper, coarse polyester, coarse plastic, coarse foam, Tacky paper, Tacky foam and/or adhesive coated paper.

It is contemplated that the geometrical configuration of the first tip is different than the geometrical configuration of the second tip. Preferably, the first and the second tips include a geometrical configuration which is at least one of diamond, circular, polygonal, triangular, slanted, square, arrow-like, rectangular and notched. More preferably, the first tip may include a different geometrical cross-section than the second tip.

It is further envisioned that at least one of the first and second tips includes a series of bristles which form a brush-like tip. Preferably, the bristles of the brush-like tip include nylon, polyester, polypropylene, fluorocarbon polymers (Teflon®), stainless steel wire, carbon steel wire, brass wire, nickel silver wire bronze wire, union fiber mix, tampico, boars hair and/or horse hair.

It is envisioned that at least one of the first and second tips is selectively detachable from its respective first and second end. The detachable tip(s) may be selectively interchangeable with an additional tip having at least one of a different geometrical configuration, different porosity, different abrasiveness and amount of bristles.

It is contemplated that the dual cleaning may include an absorbent batting disposed within at least one of the first and second reservoirs.

It is further contemplated that the dual cleaning apparatus may also include a body portion having first and second body sections. Preferably, the second body section is telescopically extendable relative to the first body section such that the body portion is selectively configurable from a first fully retracted configuration having a first length to at least one extended configuration having a second length.

A further aspect of the present disclosure includes a cleaning kit for cleaning electronic components having a container and an elongated body portion having first and second ends. Each of the ends is preferably configured to mechanically engage one of a plurality of interchangeable cleaning tips, at least one of which includes a reservoir for holding a cleaning solution and a working end for applying the cleaning solution to the electronic component.

It is envisioned that at least one of the plurality of interchangeable tips includes an abrasive working end made from coarse felt, course cellulose, coarse paper, coarse polyester, coarse plastic, coarse foam, Tacky paper, Tacky foam and/or adhesive coated paper.

In accordance with the present disclosure, it is envisioned that the solution can be at least one of Acetaldehyde, Acetamide, Acetic Acid, Acetic Anhydride, Acetone, Acetophenone, Acetyl Chloride, Acetylene Gas, Acrylonitrile, Air below 200 C, Alkazene, Aluminium Acetate, Aluminium Chloride, Aluminium Flouride, Aluminium Nitrate, Aluminium Sulfate, Ammonia, Ammonia Gas, Ammonium Carbonate, Ammonium Chloride, Ammonium Hydroxide, Ammonium Nitrate, Ammonium Persulfate, Ammonium Phosphate, Ammonium Sulfate, Amyl Acetate, Amyl Alcohol, Amyl Borate, Amyl Chloronaphthalene, Aniline, Aniline Oil, Animal Oil, Arachlor 1248, Argon, Aromatic Fuel 50%, Askarel Transformer Oil, ASTM Fuel A, ASTM Fuel B, ASTM Fuel C, ASTM Fuel D, ASTM Oil Four, ASTM Oil One, ASTM Oil Three, ASTM Oil Two, Automatic Transmission, Automotive Brake Fluid, Beer, Benzaldehyde, Benzene Sulfonic Acid, Benzene, Benzine (Ligroin), Benzoic Acid, Benzophenone, Benzyl Alcohol, Benzyl Benzoate, Benzyl Chloride, Bleach Liquor, Borax Solutions, Boric Acid, Brake Fluid, Bromine Gas, Bromobenzene, Bunker Oil, Butadiene Monomer, Butane, Butter, Butyl Alcohol, Butyl Carbitol, Butyl Celosolve, Butylaldehyde, Calcium Carbonate, Calcium Chloride, Calcium Hydroxide, Calcium Hypochlorite, Calcium Nitrate, Calcium Sulfide, Carbitol 2, Carbolic Acid (Phenol), Carbon Disulfide, Carbon Monoxide, Carbon Tetrachloride, Carbonic Acid, Castor Oil, Cellosolve, China Wood Oil, Chloracetic Acid, Tung Oil, Chlordane, Chlorinated Solvents, Chlorine Dioxide, Chlorine Trifluoride, Chlorine, Chloroform, Chlorosufonic Acid, Chrome Plating Solution, Chromic Acid, Citric Acid, Cod Liver Oil, Coffee, Coolanol Monsanto, Corn Oil, Creosote, Coal Tar, Creosylic Acid, Crude Oil, Cyclohexane, Denaturated Alcohol, Diacetone, Diacetone Alcohol, Dibenzyl Ether, Dibutyl Phthalate, Dichloro-Butane, Diesel Oil, Di-ester Lubricant, MIL-L-7808, Diethylamimine, Diethylamine Glycol, Dimethyl Formamide, Dimethyl Phthalate, Dioxane, Diphenyl, Dow Corning 550, Dow Guard, Dowtherm A, Elco 28 Lubricant, Epoxy Resins, Ethane, Ethanol, Ethyl Actoacetate, Ethyl Alcohol, Ethyl Benzene, Ethyl Benzoate, Ethyl Cellulose, Ethyl Chloride, Ethyl Chlorocarbonate, Ethyl Diamine, Ethyl Ether, Ethyl Formate, Ethyl Hexanol, Ethyl Mercaptan, Ethyl Oxalate, Ethyl Pentachlorobenzene, Ethyl Silicate, Ethylene, Ethylene Dichloride, Ethylene Glycol, Ethylene Oxide, Ethylene Trichloride, Formaldehyde, Freon 11 (M), Freon 112, Freon 113, Freon 114, Freon 114B2, Freon 12, Freon 13, Freon 21, Freon 22, Freon 31, Freon 32, Freon 502 (F22+F316), Freon C318, Freon R134A, Freon TF, Fuel Oil, Furan, Furfural, Furfuryl Alcohol, Gallic Acid, Gasoline, Gelatine, Glucose, Glycerin, Glycol, Grease, Helium, Heptane, Hexane, Hexyl Alcohol, Hydraulic Oil, Hydrazine, Hydrobromic Acid, Hydrobromic Acid, Hydrochloric Acid, Hydrocyanic Acid, Hydrofluoric Acid, Hydrogen Gas, Hydrogen Peroxide, Hydroquinone, Iodine, Iso Octane, Isobutyl Alcohol, Isopropanol, Isopropyl Acetate, Isopropyl Chloride, Isopropyl Ether, JP 3 MIL-J5624, JP 4 MIL-J5624, JP 5 MIL-J5624, JP 6 MIL-J5624, Kerosene, Lacquer Solvents, Lacquers, Lard, Lindol, Linoleic Acid, Linsed Oil, Liquefied Petroleum Gas, Lubricating Oils, Lye, Malathion, Maleic Acid, Mercuric Chloride, Mercury, Methane, Methanol, Methyl Acetate, Methyl Acrylate, Methyl Alcohol, Methyl Bromide, Methyl Butyl Ketone, Methyl Cellosolve, Methyl Chloride, Methyl Ether, Methyl Ethyl Kertone, Methyl Isobutyl Ketone, Methyl Mercaptan, Methyl Methacrylate, Methyl Oleate, Methyl Propyl Salicylate, Methylacrylic Acid, Methylene Chloride, MIL-F-25558 (RJ-1), MIL-F-25656, MIL-G-25760, MIL-H-5606, MIL-H-7083, MIL-J 5624 Milk, MIL-L-25681, MIL-R-25576 (RP-1), MIL-S-3136, MIL-S-81087, Mineral Oils, Type 1 Fuel, Monovinyl Acetate, Naphtha, Naphthalene, Naphthalenic, Natural Gas, Neatsfoot Oil, N-Hexaldehyde, Nitric Acid, Nitrobenzene, Nitroethane, Nitrogen Tetroxide, Nitrogen Gas, Nitromethane, Nitropropane, N-Octane, N-Pentane, Octyl Alcohol, Oleic Acid, Oleum, Oronite 8200, Oxalic Acid, Oxygen at 200-400 F, Cold Oxygen, Ozone, Peanut Oil, Petroleum Oil, Phenol, Phenylhydrazine, Phosphoric Acid, Phosphoric Trichloride, Pine Oil, Potassium Nitrate, Potassium Sulfate, Producer Gas, Propane, Propanol, Propyl Acetate, Propyl Alcohol, Propylene, Propylene Oxide, Pydraul, Pyranol, Pyrogard, Transformer Oil, Radiation, Rapeseed Oil, Red Oil, RJ-1 (MIL-F-25558), RP-1 (MIL-R-25576), Sea Water, Silicone Grease, Silicone Oils, Silver Nitrate, Skydrol 500, Sodium Bicarbonate, Sodium Carbonate, Sodium Chloride, Sodium Hydroxide, Soyabean Oil, Steam to 350 F, Stearic Acid, Stoddard Solvent, Styrene Monomer, Sucrose Solutions, Sulfur Chloride, Sulfur Dioxide Gas, Sulfur Hexafluoride, Sulfur Trioxide, Sulfur Acid, Sulfurous Acid, Tannic Acid, Tataric Acid, Tertiary Butyl Alcohol, Tertiary Butyl Mercaptan, Tetrabromoethane, Tetrabutyl Titanate, Tetrachloroethane, Tetrachloroethylene, Tetraethyl Lead, Tetrahydrofuran, Tetralin, Toluene, Transmission Fluid, Triethanolamine, Turbine Oil, Turpentine, Varnish, Vinegar, VV-H-910, Wagner 21B Brake Fluid, Water, Whisky and White Pine Tar.

According to another aspect of the disclosure, there is provided a cleaning pen for cleaning electronic equipment including an elongated body portion having first and second ends, a first tip integral with the first operative end, and a second tip integral with the second operative end. Each tip is selectively attachable to the body portion and includes its own cleaning solution therewith.

BRIEF DESCRIPTION OF THE DRAWINGS

Other objects and features of the present disclosure will become apparent from the following detailed description considered in connection with the accompanied drawings. It should be understood, however, that the drawings are designed for the purpose of illustration only and not as a definition of the limits of the present disclosure.

An illustrative embodiment of the subject cleaning apparatus is described herein with reference to the drawings, wherein.

DETAILED DESCRIPTION

Figure 1:
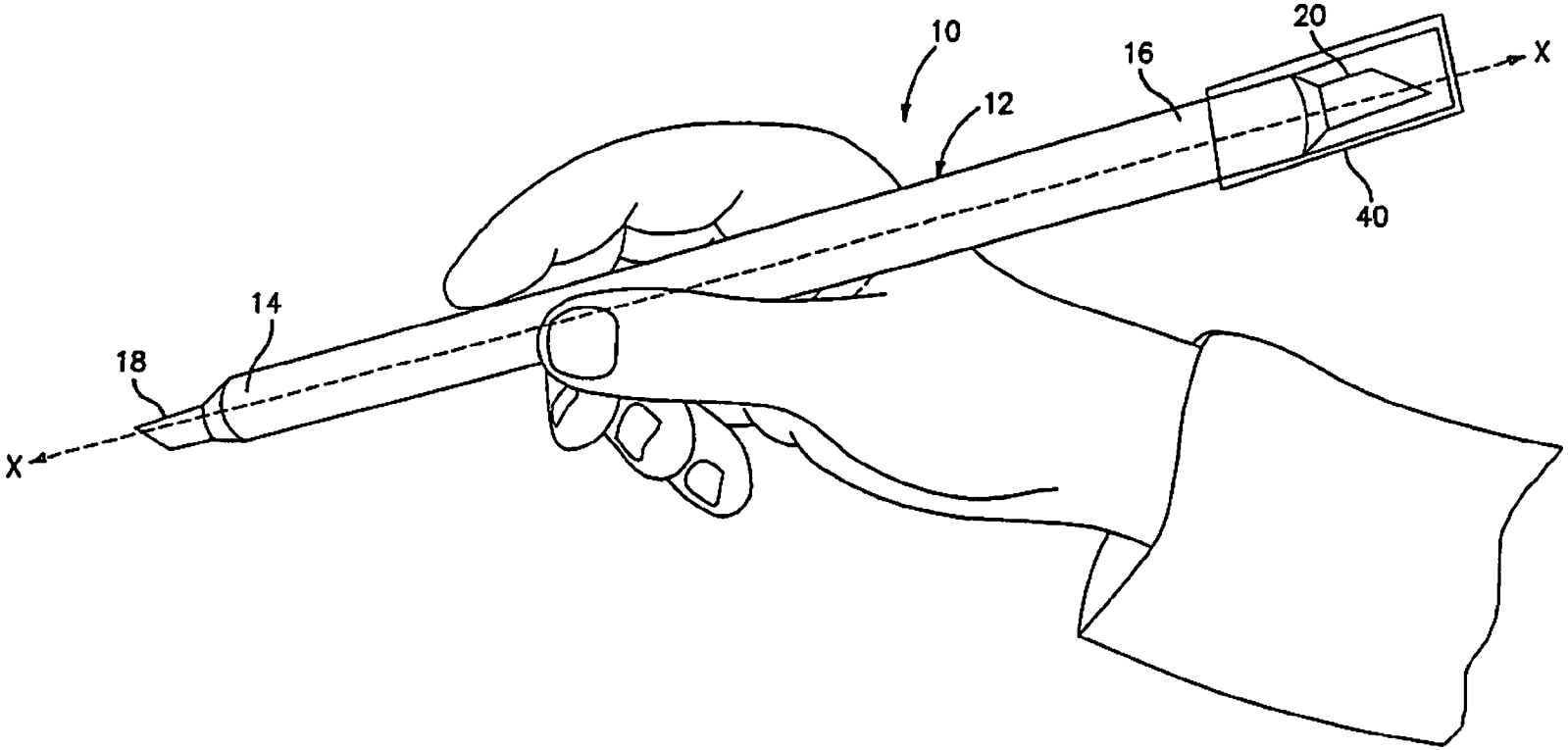
FIG. 1 is a perspective view of a dual cleaning apparatus in accordance with one embodiment of the present disclosure shown being held in a user's hand (shown in phantom)

Referring now in detail to the drawing figures in which like reference numerals identify similar or identical elements throughout the various views, one embodiment of the present disclosure is illustrated generally in FIGS. 1-5 and is designated therein as cleaning apparatus 10. As is traditional, the term "proximal" will refer to the end of the apparatus which is closer to the user, while the term "distal" will refer to the end of the apparatus which is further from the user.

Figure 2A:
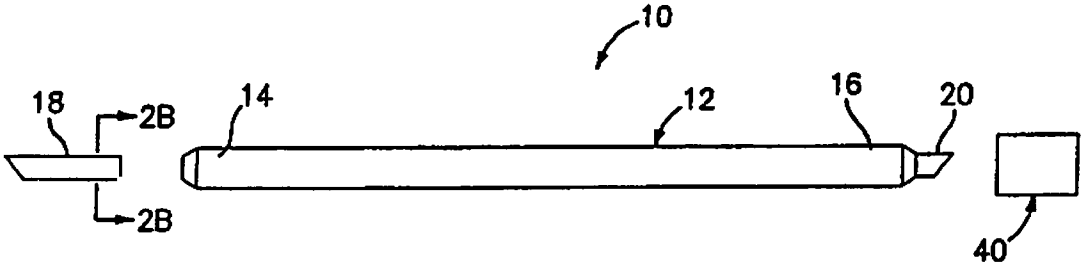
FIG. 2A is a side elevational view of the dual cleaning apparatus of FIG. 1.
Figure 2B:
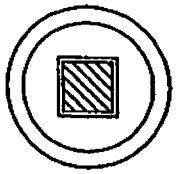
FIG. 2B is an end view of FIG. 2A.
Figure 3:
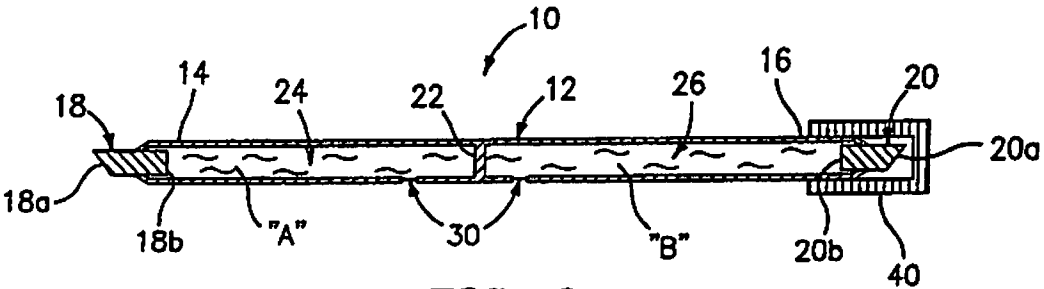
FIG. 3 is a cross-sectional, side view of the dual cleaning apparatus of FIG. 1 showing a cleaning tip disposed at each end of the cleaning apparatus.

As seen in FIGS. 1, 2A and 3, cleaning apparatus (or cleaning pen) 10 is generally pen-like and includes an elongated body portion 12 having first and second ends 14, 16, respectively, having a pair of internal reservoirs 24, 26 defined therebetween. Preferably, ends 14 and 16 are disposed in axial opposition with respect to one another along longitudinal axis "X" defined along elongated body portion 12. It is envisioned that the elongated body portion may also be offset along axis "X" depending upon a particular purpose, e.g., to facilitate handling. It is also contemplated that elongated body portion 12 may be made from a flexible or semi-resilient material such that body portion 12 can be bent off axis to facilitate cleaning.

Each of the first and second operative ends 14 and 16, respectively, includes a nib or working tip 18, 20, respectively, extending at least partially therefrom. It is envisioned that one or both of the tips 18 and 20 may be integrally associated with its respective ends 14 and 16 such that cleaning pen 10 is disposable after a given number of cleanings. It is also envisioned that cleaning pen 10 may be partially disposable or reusable, i.e., the working tips 18 and 20 are disposable or interchangeable. For example, and as best seen in FIG. 2A, tips 18 and/or 20 can be selectively removed from body portion 12 and replaced with new and/or fresh tips as needed. It is envisioned that tips 18, 20 are releasably secured to first and second operative ends 14, 16, respectively, by one of at least a snap-fit type engagement, a friction-fit type engagement or the like. One or more caps 40 may be included which each mechanically interfaces with a respective end 14, 16 to cover the working tip 18, 20 and protect the tip from damage and/or drying out.

As mentioned above, body portion 12 can be either rigid or pliable/flexible (in order to permit bending and/or squeezing). Preferably, body portion 12 is fabricated from plastic (e.g., polyethylene (PE), polypropylene (PP), polyvinylidene Fluoride (PVDF) and/or other plastics including ABS, acetal, acrylic, Cab, Delrin, kel-F, noyl, novus, nylon, peek, phenolic, polycarbonate, pvc, pvc-cpvc, rexolite, rulon, vinyl, biodegradable plastic-wheat and polymer mix), coated paper, coated cardboard or the like. It is envisioned that body portion 12 may be made from a rigid material to facilitate handling and to reduce wear such as with a reusable cleaning pen 10. As such, a dispenser mechanism (not shown) may be included to supply the cleaning solution to the tip. Such dispensers are commonly known in the art.

Body portion 12 is preferably designed for manual gripping such that the user can easily manipulate the cleaning pen 10 as needed in order to make use of either the first operative end 14 or the second operative end 16. It is envisioned that the elongated body portion 12 may include a series of elongated features to promote handling, e.g., grip-enhancing rubber inserts, scalloping, finger-rests, thumb-rests, ridges, etc.

As seen best in FIG. 3 and as mentioned above, body portion 12 defines a pair of internal reservoirs 24, 26 which are separated by an internal transverse wall 22. Preferably, the first reservoir 24 is in fluid communication with the first working tip 18 and the second reservoir 26 is in fluid communication with the second working tip 20. First reservoir 24 preferably retains a first solution "A" therein, while second reservoir 26 preferably retains a second solution "B" therein. As seen in FIG. 3, the first tip 18 includes a distal end 18*a* which extends from the first end 14 and a proximal end 18*b* which extends into the first reservoir 24 and into contact with the first solution "A". Likewise, the second tip 20 includes a distal end 20*a* which extends from the second end 16 and a proximal end 20*b* which extends into the second reservoir 26 and into contact with the second solution "B". Preferably, tips 18 and 20 are fabricated from a material which permits the tip and solution combination to act in a wick-like fashion.

It is also envisioned that the working tip 18 (and/or 20) may include a self contained reservoir 27 to enable a new (or other) working tip 18 and reservoir 27 to be interchanged to resupply the cleaning pen 10 and/or to interchange a different solution or different tip type for cleaning purposes. As can be appreciated, this would enable the cleaning pen 10 to be used to clean a wide variety of electronic equipment.

Preferably, the first solution "A" is a solvent and the second solution "B" is a cleaner. Alternatively, both solutions "A" and "B" may be the same solution depending upon a particular purpose. In this manner, cleaning pen 10 retains two solutions which can be selected by the user as needed when cleaning and removing contaminants from electronic components.

A suitable cleaner for either solution "A" or solution "B" can include an alcohol-based solution, e.g., isopropyl alcohol, or a non-alcohol-based solution, e.g., a citric cleaner. Suitable solutions for solution "A" and solution "B" may be selected from the table shown below:

| | | |
|---|---|---|
| Acetaldehyde | Acetamide | Acetic Acid, Glacial |
| Acetic Anhydride | Acetone | Acetophenone |
| Acetyl Chloride | Acetylene Gas | Acrylonitrile |
| Air below 200 C. | Alkazene | Aluminium Acetate |
| Aluminium Chloride | Aluminium Flouride | Aluminium Nitrate |
| Aluminium Sulfate | Ammonia, Anhydrous | Ammonia Gas, Cold |
| Ammonia, Gas, Hot | Ammonium Carbonate | Ammonium Chloride |
| Ammonium Hydroxide, Concentrated | Ammonium Nitrate | Ammonium Persulfate Solution |
| Ammonium Phosphate | Ammonium Sulfate | Amyl Acetate |
| Amyl Alcohol | Amyl Borate | Amyl Chloronaphthalene |
| Aniline | Aniline Oil | Animal Oil |
| Arachlor 1248 | Argon | Aromatic Fuel 50% |
| Askarel Transformer Oil | ASTM Fuel A | ASTM Fuel B |
| ASTM Fuel C | ASTM Fuel D | ASTM Oil Four |
| ASTM Oil One | ASTM Oil Three | ASTM Oil Two |
| Automatic Transmission Fluid | Automotive Brake Fluid | Beer |
| Benzaldehyde | Benzene Sulfonic Acid | Benzene |
| Benzine (Ligroin) | Benzoic Acid | Benzophenone |
| Benzyl Alcohol | Benzyl Benzoate | Benzyl Chloride |
| Bleach Liquor | Borax Solutions | Boric Acid |
| Brake Fluid | Bromine Gas | Bromobenzene |
| Bunker Oil | Butadiene Monomer | Butane |
| Butter | Butyl Alcohol | Butyl Carbitol |
| Butyl Celosolve | Butylaldehyde | Calcium Carbonate |
| Calcium Chloride | Calcium Hydroxide | Calcium Hypochlorite |
| Calcium Nitrate | Calcium Sulfide | Carbitol 2 |
| Carbolic Acid (Phenol) | Carbon Disulfide | Carbon Monoxide |
| Carbon Tetrachloride | Carbonic Acid | Castor Oil |
| Cellosolve | China Wood Oil, Tung Oil | Chloracetic Acid |
| Chlordane | Chlorinated Solvents | Chlorine Dioxide |
| Chlorine Trifluoride | Chlorine, Dry | Chlorine, Wet |
| Chloroform | Chlorosufonic Acid | Chrome Plating Solution |
| Chromic Acid | Citric Acid | Cod Liver Oil |
| Coffee | Coolanol Monsanto | Corn Oil |
| Creosote, Coal Tar | Creosylic Acid | Crude Oil (Asphalt Base) |
| Cyclohexane | Denaturated Alcohol | Diacetone |
| Diacetone Alcohol | Dibenzyl Ether | Dibutyl Phthalate |
| Dichloro-Butane | Diesel Oil | Di-ester Lubricant MIL-L-7808 |
| Diethylamimine | Diethylamine Glycol | Dimethyl Formamide |
| Dimethyl Phthalate | Dioxane | Diphenyl |
| Dow Corning 550 | Dow Guard | Dowtherm A |
| Elco 28 Lubricant | Epoxy Resins | Ethane |
| Ethanol | Ethyl Actoacetate | Ethyl Alcohol |
| Ethyl Benzene | Ethyl Benzoate | Ethyl Cellulose |
| Ethyl Chloride | Ethyl Chlorocarbonate | Ethyl Diamine |
| Ethyl Ether | Ethyl Formate | Ethyl Hexanol |
| Ethyl Mercaptan | Ethyl Oxalate | Ethyl Pentachlorobenzene |
| Ethyl Silicate | Ethylene | Ethylene Dichloride |
| Ethylene Glycol | Ethylene Oxide | Ethylene Trichloride |
| Formaldehyde | Freon 11 (M) | Freon 112 |
| Freon 113 | Freon 114 | Freon 114B2 |
| Freon 12 | Freon 13 | Freon 21 |
| Freon 22 | Freon 31 | Freon 32 |
| Freon 502 (F22 + F316) | Freon C318 | Freon R134A |
| Freon TF | Fuel Oil | Furan |
| Furfural | Furfuryl Alcohol | Gallic Acid |
| Gasoline, Automotive | Gelatine | Glucose |
| Glycerin | Glycol, General | Grease, Petroleum Base |
| Helium | Heptane | Hexane |
| Hexyl Alcohol | Hydraulic Oil, Pertoleum | Hydrazine |
| Hydrobromic Acid | Hydrobromic Acid, Gas | Hydrochloric Acid |
| Hydrocyanic Acid | Hydrofluoric Acid | Hydrogen Gas |
| Hydrogen Peroxide | Hydroquinone | Iodine |
| Iso Octane | Isobutyl Alcohol | Isopropanol |
| Isopropyl Acetate | Isopropyl Chloride | Isopropyl Ether |
| JP 3 MIL-J5624 | JP 4 MIL-J5624 | JP 5 MIL-J5624 |
| JP 6 MIL-J5624 | Kerosene | Lacquer Solvents |

-continued

| | | |
|---|---|---|
| Lacquers | Lard, Animal Fat | Lindol, Hydraulic Fluid (Phosphate Ester Type) |
| Linoleic Acid | Linsed Oil | Liquefied Petroleum Gas (LPG) |
| Lubricating Oils, Petroleum Base | Lye | Malathion |
| Maleic Acid | Mercuric Chloride | Mercury |
| Methane | Methanol | Methyl Acetate |
| Methyl Acrylate | Methyl Alcohol | Methyl Bromide |
| Methyl Butyl Ketone | Methyl Cellosolve | Methyl Chloride |
| Methyl Ether | Methyl Ethyl Kertone (MEK) | Methyl Isobutyl Ketone (MIBK) |
| Methyl Mercaptan | Methyl Methacrylate | Methyl Oleate |
| Methyl Propyl Salicylate | Methylacrylic Acid | Methylene Chloride |
| MIL-F-25558 (RJ-1) | MIL-F-25656 | MIL-G-25760 |
| MIL-H-5606 | MIL-H-7083 | MIL-J 5624, JP-3, JP-4, JP-5 |
| Milk | MIL-L-25681 | MIL-R-25576 (RP-1) |
| MIL-S-3136, Type 1, Fuel | MIL-S-81087 | Mineral Oils |
| Monovinyl Acetate | Naphtha | Naphthalene |
| Naphthalenic | Natural Gas | Neatsfoot Oil |
| N-Hexaldehyde | Nitric Acid | Nitrobenzene |
| Nitroethane | Nitrogen Tetroxide | Nitrogen, Gas |
| Nitromethane | Nitropropane | N-Octane |
| N-Pentane | Octyl Alcohol | Oleic Acid |
| Oleum (Fuming Sulfuric Acid) | Oronite 8200 | Oxalic Acid |
| Oxygen, 200-400 F | Oxygen, Cold | Ozone |
| Peanut Oil | Petroleum Oil | Phenol |
| Phenylhydrazine | Phosphoric Acid | Phosphoric Trichloride |
| Pine Oil | Potassium Nitrate | Potassium Sulfate |
| Producer Gas | Propane | Propanol |
| Propyl Acetate | Propyl Alcohol | Propylene |
| Propylene Oxide | Pydraul, 10E | Pydraul, 230 C, 312 F, 540 C |
| Pydraul, 30E, 50E, 65E, 90E | Pyranol, Transformer Oil | Pyrogard (Phosphate Ester) |
| Radiation | Rapeseed Oil | Red Oil |
| RJ-1 (MIL-F-25558) | RP-1 (MIL-R-25576) | Sea Water |
| Silicone Grease | Silicone Oils | Silver Nitrate |
| Skydrol 500 | Sodium Bicarbonate | Sodium Carbonate |
| Sodium Chloride | Sodium Hydroxide | Soyabean Oil |
| Steam to 350 F | Stearic Acid | Stoddard Solvent |
| Styrene Monomer | Sucrose Solutions | Sulfur Chloride |
| Sulfur Dioxide Gas, Dry | Sulfur Dioxide Gas, Wet | Sulfur Dioxide, Liquefied |
| Sulfur Hexafluoride | Sulfur Trioxide | Sulfur Acid (Concentrated) |
| Sulfurous Acid | Tannic Acid | Tataric Acid |
| Tertiary Butyl Alcohol | Tertiary Butyl Mercaptan | Tetrabromoethane |
| Tetrabutyl Titanate | Tetrachloroethane | Tetrachloroethylene |
| Tetraethyl Lead | Tetrahydrofuran | Tetralin |
| Toluene | Transmission Fluid, Type A | Triethanolamine |
| Turbine Oil | Turpentine | Varnish |
| Vinegar | VV-H-910 | Wagner 21B Brake Fluid |
| Water, Fresh | Whisky | White Pine Tar |

Figure 8:
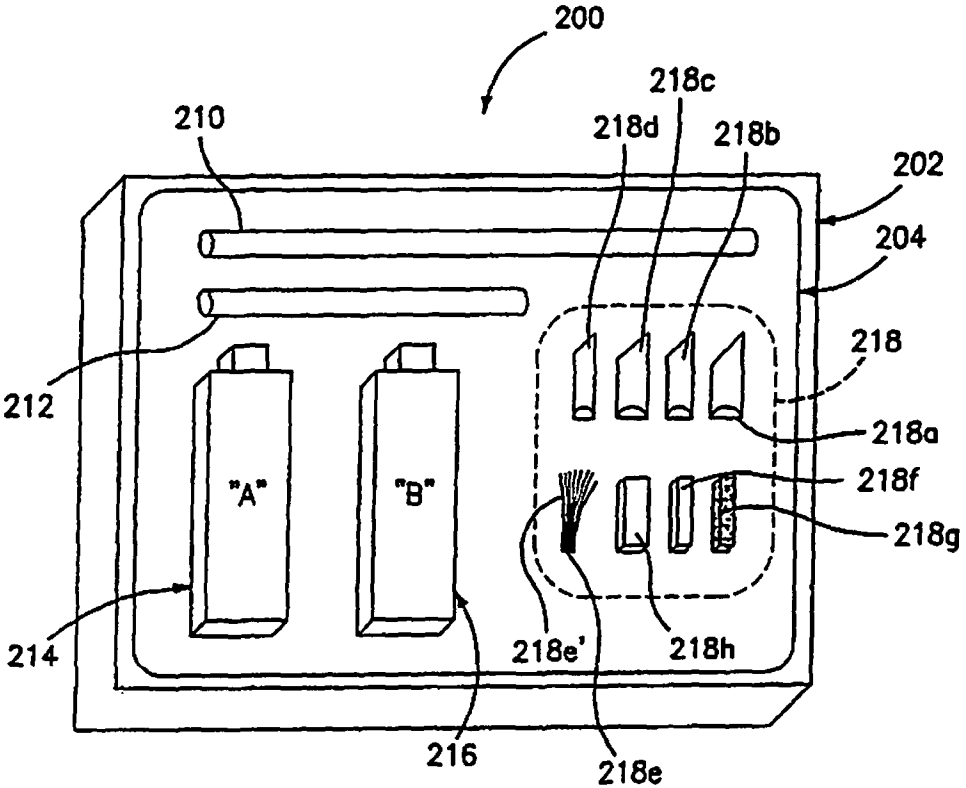
FIG. 8 illustrates a cleaning kit including the dual cleaning apparatus as disclosed herein.

It is envisioned that the working tips 18 and 20 can include a series of bristles **218*e*' to form a brush-like structure 218*e* or the working tip may be an abrasive working tip 218*g* depending on the particular cleaning need (see FIG. 8). For example, a brush-like tip 218*e* may be desirable for simply applying the solution to the target work site, while an abrasive tip 218*g* may be desirable to enhance cleaning via rubbing or friction. The bristles 218*e*' of the brush-like tip(s) 218*e* may be fabricated from nylon, polyester, polypropylene, Teflon, stainless steel wire, carbon steel wire, brass wire, nickel silver wire bronze wire, union fiber mix, tampico, boars hair, horse hair or the like. The abrasive tip(s) 218*g*** may be fabricated from course or smooth felt, cellulose, paper, polyester, plastic, foam, Tacky paper, Tacky foam, adhesive coated paper, wool, stitchbond, Spun-tip, urethane or the like.

Felt-type materials include, but are not limited to the following:

| Felt Type | F1 | F-50 | F-2 | F-3 | F-51 | F-5 | F-6 | F-7 |
|---|---|---|---|---|---|---|---|---|
| Capalarity in Inches | 4.0 | 4.0 | 4.0 | 4.0 | 4.0 | 3.0 | 3.0 | 3.0 |
| % by Vol. | >175 | >180 | >175 | >190 | >170 | >250 | >225 | >225 |
| % by Wt. | 74 | 75 | 74 | 76 | 75 | 80 | 80 | 80 |

| Felt Type | F-55 | F-10 | F-11 | F-12 | F-13 | F-15 | F-26 | 16S |
|---|---|---|---|---|---|---|---|---|
| Capalarity in Inches | 3.0 | 2.5 | 2.5 | 2.5 | 2.5 | 2.5 | — | 4.0 |
| % by Vol. | >225 | >400 | >375 | >350 | >350 | >350 | >400 | >175 |
| % by Wt. | 81 | 88 | 88 | 88 | 88 | 88 | 88 | 92 |

| Felt Type | 20S | 26S | 32S |
|---|---|---|---|
| Capalarity in Inches | 4.5 | 5.0 | 5.5 |
| % by Vol. | >100 | >75 | >50 |
| % by Wt. | | | |

Figure 4A:
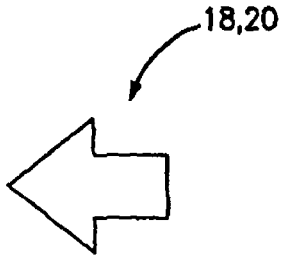
FIGS. 4A-4J are enlarged side elevational views illustrating various geometrical configurations of the tips.
Figure 4B:
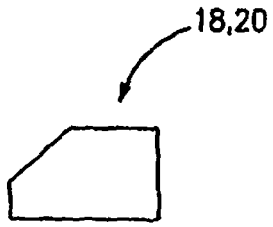
Figure 4C:
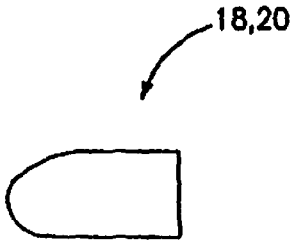
Figure 4D:
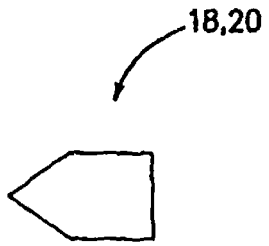
Figure 4E:
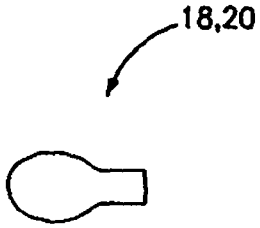
Figure 4F:
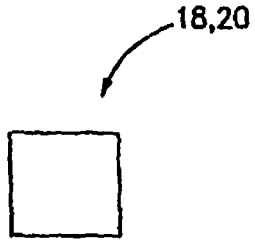
Figure 4G:
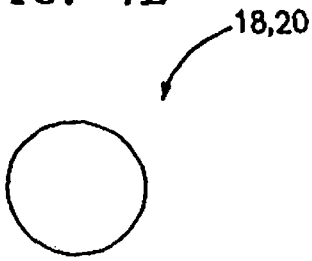
Figure 4H:
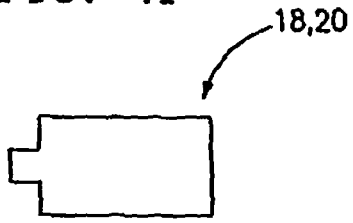
Figure 4I:
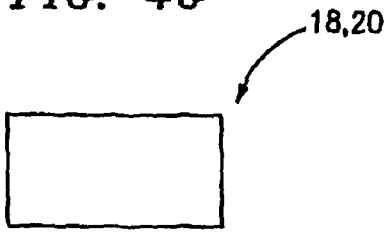
Figure 4J:
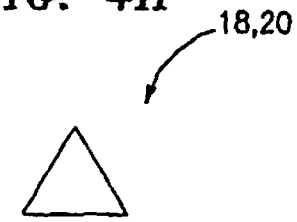
Figure 5A:
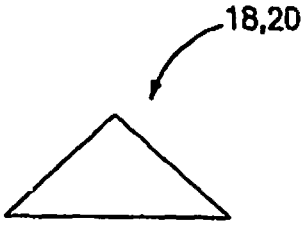
FIGS. 5A-5E are enlarged, end elevational views geometrically-shaped cross sections of the tips.
Figure 5B:
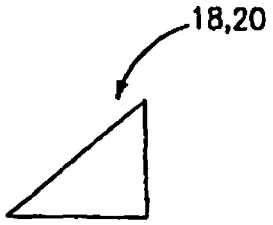
Figure 5C:
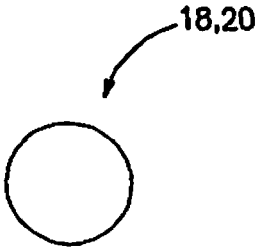
Figure 5D:
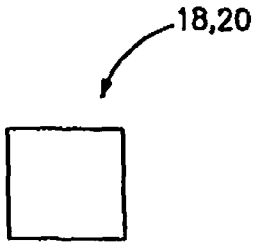
Figure 5E:
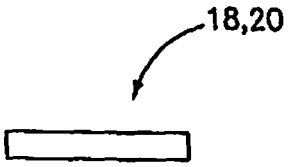

FIGS. 4A-4J and FIGS. 5A-5E show various geometrical shapes and configurations for the working tips 18 and 20. From a side elevational view the geometrical configurations include but are not limited to the following: arrow-like (FIG. 4A), wedge-like (FIG. 4B), bullet-like (FIG. 4C), pointed (FIG. 4D), swab-like (FIG. 4E), square (FIG. 4F), circular (FIG. 4G), notched (FIG. 4H), rectilinear (FIG. 4I) and/or triangular (FIG. 4J). The cross-sectional end view (taken along line A-A of FIG. 2A) of the cleaning pen 10 may also include different geometrical configurations to enhance cleaning, e.g., triangular (FIG. 5A), slanted (FIG. 5B), round (FIG. 5C), square (FIG. 5D), rectangular (FIG. 5E) and the like.

Figure 6:
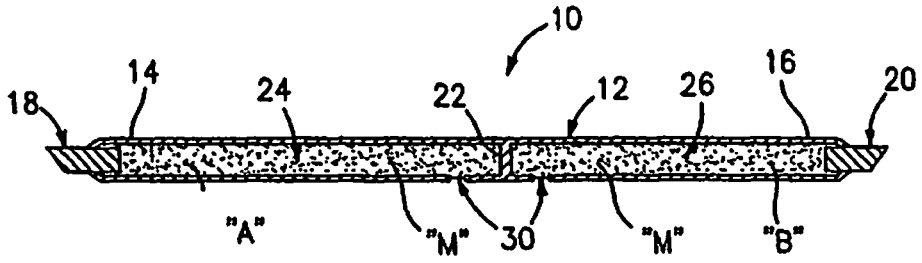
FIG. 6 is cross-sectional, side view of another embodiment of the dual cleaning apparatus according to the present disclosure.

As seen in FIG. 6, each reservoir 24 and 26 can include a saturatable batting material "M" retained therein. Batting material "M" of each reservoir 24 and 26 can be independently soaked with either solution "A" or solution "B" for eventual wicking to tips 18, 20, respectively. Batting material "M" can be fabricated from cellulose, crimped cellulose, cotton, polyester, spun-bonded polyester, foam, urethane, wool felt, synthetic felt, fiber, muslin, plastic, PE, PVDF, acetate and the like.

Figure 7A:
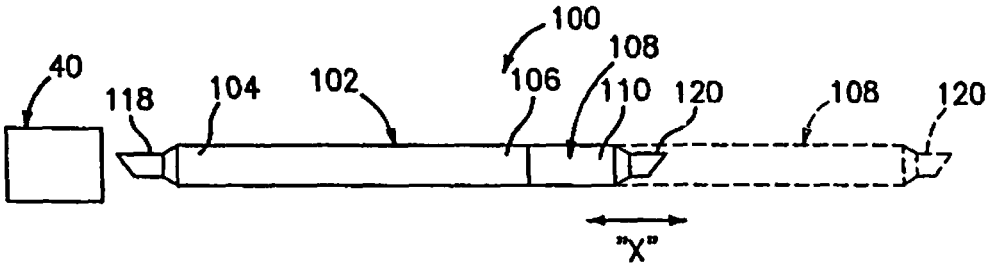
FIGS. 7A, 7AA and 7B are side elevational views of additional embodiments of the dual cleaning apparatus according to the present disclosure illustrating telescopic extension of the cleaning apparatus along a longitudinal axis "X"
Figure 7B:
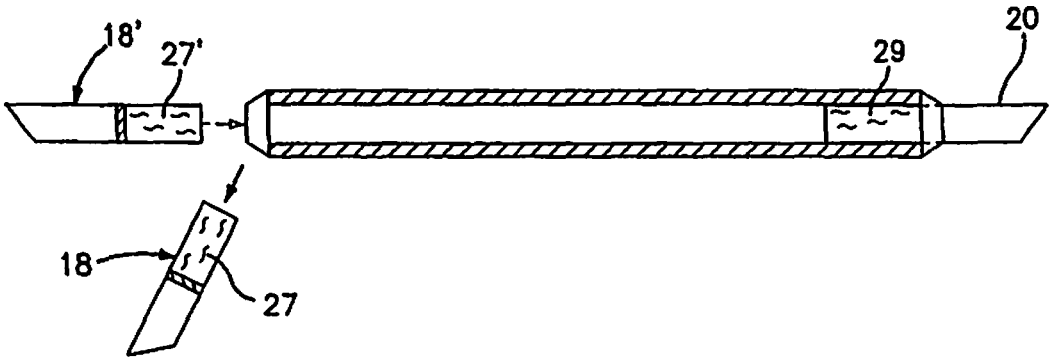
Figure 7A:
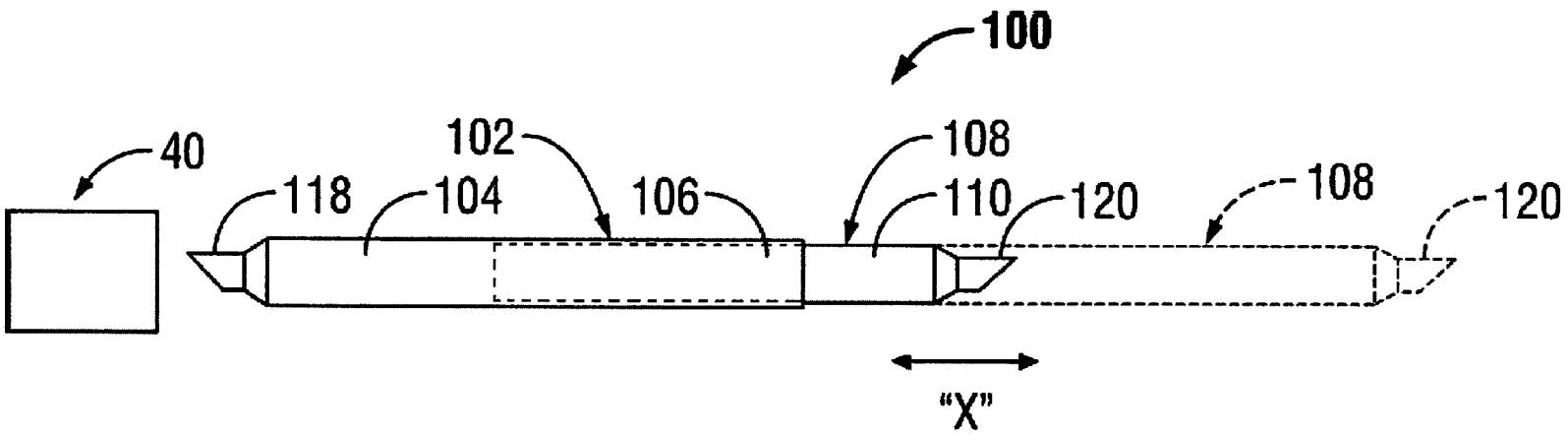

Turning now to FIG. 7A, an alternate embodiment of a cleaning pen, in accordance with the present disclosure, is shown generally as 100. Cleaning pen 100 includes a first body portion 102 having an operative distal end 104 and a proximal end 106, and a second body portion 108 having an operative distal end 110 and a proximal end configured and dimensioned for telescopic reception within proximal end 106 of first body portion 102. Much like the various embodiments described above, cleaning pen 100 includes a first tip 118 operatively coupled to distal end 104 and a second tip 120 operatively coupled to distal end 110. Preferably, each tip 118 and 120 is saturatable with separate distinct solutions which "wick" from the respective batting material "M" or which emanate from internal reservoirs as described with respect to the embodiments disclosed in FIGS. 1-5E above.

In operation, first body portion 102 and second body portion 108 are axially displaceable relative to one another in the directions of double-headed arrow "X". In this manner the cleaning pen 100 is telescopic so as to have a shorter overall axial length for storage and/or transportation and a longer overall axial length for cleaning purposes. It is envisioned that cleaning pen 100 can be provided with a locking mechanism (not shown), such as, for example, a bayonet-type fitting, which would maintain cleaning apparatus 100 in an extended length during use. Alternatively, an eccentric cam may be employed such that when first body portion 102 is rotated relative to second body portion 108 the cam rotates and wedges against the internal periphery of first body portion 102 to lock the two body portions relative to one another.

As mentioned above, cleaning pen 10 of FIGS. 1-3 and cleaning pen 100 of FIG. 7A further include caps 40 which are removably attachable to either end thereof. Preferably, caps 40 provide a substantially air tight closure about tips 18, 20 of cleaning pen 10 and tips 118, 120 of cleaning pen 100, thus protecting the tips 18, 20 from external environmental conditions (e.g., drying, dirt, damage, etc.) when not in use. Caps 40 are removed from the ends of cleaning pen 10, 100 when the respective end of cleaning pen 10, 100 is to be used.

In use, and depending on the particular cleaning application of electrical component to be cleaned, the user selects a cleaning tip which is most appropriate for the cleaning task. For example, the user can select or configure a cleaning tip to have a first solution which dissolves adhesive from the area to be cleaned and a second solution which cleans the first solution from the area to be cleaned. In addition, the user can select the material of the tip used to apply the solutions to the cleaning area, such as, for example, an abrasive material which can be used to scrub the area to be cleaned or a brush which can be used to apply or remove the cleaning solution from the cleaning area. As can be appreciated, depending on the configuration and geometry of the area to be cleaned, the user can select a tip which is best suited for cleaning purposes.

The present disclosure also includes a method of cleaning electronic components. The method includes the following steps: providing a cleaning apparatus including an elongated body portion having first and second ends, a first tip integral with the first operative end, the first tip including a first solution for performing a first cleaning function on the electronic equipment, and a second tip integral with the second operative end, the second tip including a second solution to the second operative end for performing a second cleaning function on the electronic equipment. The method further including the steps of filling a first reservoir 24 with a first solution "A"; filling a second reservoir 26 with a second solution "B"; applying the first solution to clean the target area; applying the second solution to clean the target area or to remove the first solution.

As seen in FIGS. 3 and 6, it is envisioned that cleaning pen 10 can be provided with at least one port 30 formed in body portion 12. Preferably, cleaning pen 10 is provided with a port 30 formed in body portion 12 which is in fluid communication with a respective one of each reservoir 24 and 26. Ports 30 can be used to refill reservoirs 24 and 26 when they are low or are empty of solution "A" or "B". It is further contemplated that body portion 12 can be provided with a clear or transparent portion (not shown) formed therewith. In this manner, the level of solution "A" or "B" can be readily ascertained by looking through the transparent portion.

The afore-described cleaning pen 10 is designed to provide dual or multipurpose cleaning functions within a single cleaning tool. For example, the first end 14 of the cleaning pen 10 may be employed to clean thermal or magnetic r/w/s heads of an electronic component and the second end 16 of the cleaning pen 10 may be employed to clean the rollers and/or platens of the electronic equipment. As can be appreciated from the present disclosure, the user may selectively employ a variety of cleaning solutions and interchange a variety of tips as needed to clean a myriad of electrical components.

Turning now to FIG. 8, the present disclosure includes a cleaning kit 200 for cleaning a variety of electronic equipment. Kit 200 includes a container 202 for storing the various cleaning components contained in kit 200. Container 202 can be fabricated from any material suitable for storing the cleaning components, such as, for example, plastic, metal and wood. It is contemplated that container 202 can be provided with one or more inserts 204 having a plurality of molded retaining receptacles configured and dimensioned to selectively retain the various elements of the cleaning components.

Kit 200 includes: one or more cleaning apparatii 210 of different lengths (and/or telescopic); a first bottle 214 containing solution "A"; a second bottle 216 containing solution "B"; and a plurality of interchangeable tips 218*a*-218*h*. The tips may include: foam tips 218*a*-218*d* of varying geometries; felt tips 218*h* and brush-like tips 218*e* and/or absorbable tips 218*g*.

It is further envisioned that one of the first and second ends of the cleaning apparatus can be provided with a source of light, such as, for example, an bulb, an LED and/or a light pipe which can be used for illuminating the work area for cleaning purposes.

Figure 9:
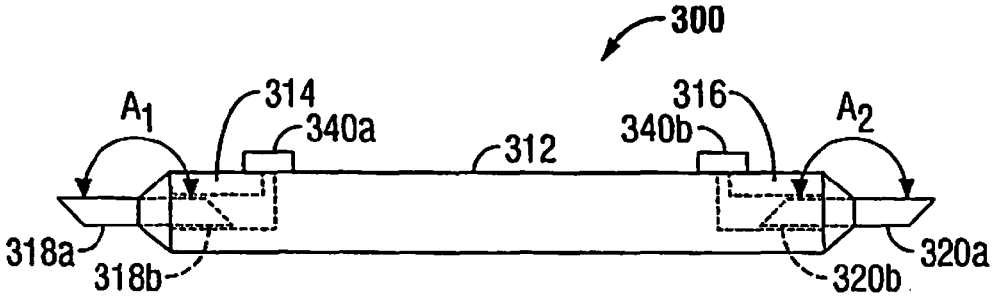
FIG. 9 is a side schematic view of another dual cleaning apparatus according to the present disclosure showing a pair of selectively reversible tips at each end of the dual cleaning apparatus.

FIG. 9 shows yet another dual cleaning pen 300 according to the present disclosure which includes a pair of selectively reversible tips 318*a*, 318*b* and 320*a*, 320*b* which allow the user to utilize and carry four different tip configurations in a single unit pen. As can be appreciated, any of the aforementioned tip configurations a may be utilized with pen 300 depending upon a particular purpose. For example, each tip, e.g., 318*a*, may be dimensioned according to one of the particular geometrical configurations disclosed herein and each tip, e.g., 318*a*, may include one of the various solutions disclosed herein or one of the aforementioned textures disclosed herein essentially enabling the pen 300 to have four different cleaning tips 318*a*, 318*b* and 320*a*, 320*b* for four different cleaning purposes. The pen 300 may include an actuating mechanism 340*a*, 340*b* to facilitate reversing the tips 318*a*, 318*b* and 320*a*, 320*b*. The actuating mechanism 340*a*, 340*b* may simply extend the tips 318*a*, 318*b* and 320*a*, 320*b* to allow the user to manually reverse the tips or the actuating mechanism 340*a*, 340*b* may be designed to automatically rotate the tips when actuated.

Figure 10A:
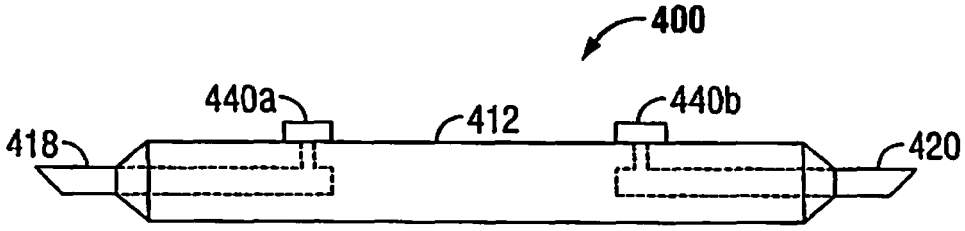
FIG. 10A is a side view of yet another dual cleaning apparatus according to the present disclosure with the tips shown in retracted configuration.
Figure 10B:
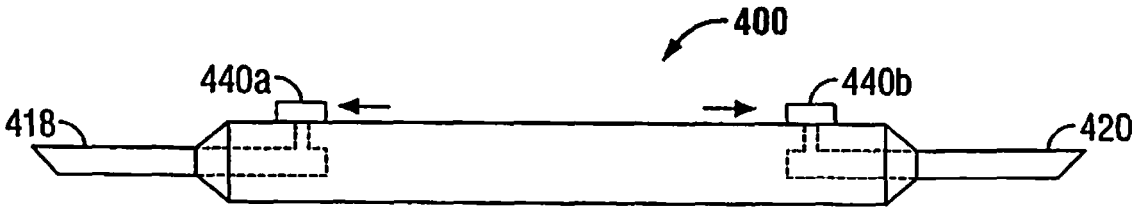
FIG. 10B is a side view of the dual cleaning apparatus of FIG. 10A showing the tips in extended configuration.

FIGS. 10A and 10B show yet another cleaning pen 400 according to the present disclosure which includes at least one selectively extendible and retractable tip, e.g., tip 418 and/or tip 420. It is envisioned that each tip 418, 420 may be selectively extended and retracted depending upon a particular purpose, e.g., to reach a certain electrical component for cleaning purposes. The pen 400 may also include a slide-like actuator 440*a*, 440*b* for deploying and retracting the tip 418, 420 as desire during cleaning. Other actuators are also envisioned or the tips may be extended and retracted manually depending upon a particular purpose or to reduce manufacturing costs.

While several embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of preferred embodiments. Those skilled in the art will envision other modifications within the scope and spirit of the claims appended hereto.

The invention claimed is:

1. A cleaning apparatus, comprising:

an elongated body portion having first and second ends and first and second body sections;

a first tip in mechanical engagement with the first end, the first tip including a first solution for performing a first cleaning function; and a second tip in mechanical engagement with the second end, the second tip including a second solution for performing a second cleaning function;

wherein said second body section is telescopically extendable relative to said first body section such that said body portion is selectively extendable from a first fully retracted operable, cleaning position having a first length to at least one extended operable, cleaning position having a second length, and wherein at least one of the first cleaning solution and the second cleaning solution is usable to perform a cleaning function when the body portion is in both the fully refracted operable, cleaning position and the extended operable, cleaning position.

2. The cleaning apparatus according to claim 1, wherein the elongated body portion is hollow and defines a pair of first and second reservoirs, said first reservoir in fluid connection with said first tip and said second reservoir in fluid communication with said second tip.

3. The cleaning apparatus according to claim 2, wherein at least one of the first and second tips is an abrasive structure.

4. The cleaning apparatus according to claim 3, wherein at least one of the first and second tips is selected from the group consisting of: coarse felt, course cellulose, coarse paper, coarse polyester, coarse plastic, coarse foam, Tacky paper, Tacky foam and adhesive coated paper.

5. The cleaning apparatus according to claim 2, further including an absorbent batting disposed within at least one of said first and second reservoirs.

6. The cleaning apparatus according to claim 2, wherein the first reservoir contains said first cleaning solution and the second reservoir contains said second cleaning solution.

7. The cleaning apparatus according to claim 6, wherein at least one of said first and second cleaning solutions is communicated to a respective first and second tip in a wick-like fashion.

8. The cleaning apparatus according to claim 1, wherein the first cleaning solution is selected from the group consisting of: Acetaldehyde, Acetamide, Acetic Acid, Acetic Anhydride, Acetone, Acetophenone, Acetyl Chloride, Acetylene Gas, Acrylonitrile, Air below 200 C, Alkazene, Aluminium Acetate, Aluminium Chloride, Aluminium Flouride, Aluminium Nitrate, Aluminium Sulfate, Ammonia, Ammonia Gas, Ammonium Carbonate, Ammonium Chloride, Ammonium Hydroxide, Ammonium Nitrate, Ammonium Persulfate, Ammonium Phosphate, Ammonium Sulfate, Amyl Acetate, Amyl Alcohol, Amyl Borate, Amyl Chloronaphthalene, Aniline, Aniline Oil, Animal Oil, Arachlor 1248, Argon, Aromatic Fuel 50%, Askarel Transformer Oil, ASTM Fuel A, ASTM Fuel B, ASTM Fuel C, ASTM Fuel D, ASTM Oil Four, ASTM Oil One, ASTM Oil Three, ASTM Oil Two, Automatic Transmission, Automotive Brake Fluid, Beer, Benzaldehyde, Benzene Sulfonic Acid, Benzene, Benzine (Ligroin), Benzoic Acid, Benzophenone, Benzyl Alcohol, Benzyl Benzoate, Benzyl Chloride, Bleach Liquor, Borax Solutions, Boric Acid, Brake Fluid, Bromine Gas, Bromobenzene, Bunker Oil, Butadiene Monomer, Butane, Butter, Butyl Alcohol, Butyl Carbitol, Butyl Celosolve, Butylaldehyde, Calcium Carbonate, Calcium Chloride, Calcium Hydroxide, Calcium Hypochiorite, Calcium Nitrate, Calcium Sulfide, Carbitol 2, Carbolic Acid (Phenol), Carbon Disulfide, Carbon Monoxide, Carbon Tetrachloride, Carbonic Acid, Castor Oil, Cellosolve, China Wood Oil, Chloracetic Acid, Tung Oil, Chlordane, Chlorinated Solvents, Chlorine Dioxide, Chlorine Trifluoride, Chlorine, Chloroform, Chlorosufonic Acid, Chrome Plating Solution, Chromic Acid, Citric Acid, Cod Liver Oil, Coffee, Coolanol Monsanto, Corn Oil, Creosote, Coal Tar, Creosylic Acid, Crude Oil, Cyclohexane, Denaturated Alcohol, Diacetone, Diacetone Alcohol, Dibenzyl Ether, Dibutyl Phthalate, Dichloro-Butane, Diesel Oil, Di-ester Lubricant, MIL-L-7808, Diethylaniimine, Diethylamine Glycol, Dimethyl Formamide, Dimethyl Phthalate, Dioxane, Diphenyl, Dow Corning 550, Dow Guard, Dowtherm A, Elco 28 Lubricant, Epoxy Resins, Ethane, Ethanol, Ethyl Actoacetate, Ethyl Alcohol, Ethyl Benzene, Ethyl Benzoate, Ethyl Cellulose, Ethyl Chloride, Ethyl Chlorocarbonate, Ethyl Diamine, Ethyl Ether, Ethyl Formate, Ethyl Hexanol, Ethyl Mercaptan, Ethyl Oxalate, Ethyl Pentachlorobenzene, Ethyl Silicate, Ethylene, Ethylene Dichloride, Ethylene Glycol, Ethylene Oxide, Ethylene Trichloride, Formaldehyde, Freon 11 (M), Freon 112, Freon 113, Freon 114, Freon 114B2, Freon 12, Freon 13, Freon 21, Freon 22, Freon 31, Freon 32, Freon 502 (F22+F316), Freon C318, Freon R134A, Freon TF, Fuel Oil, Furan, Furfural, Furfiiryl Alcohol, Gallic Acid, Gasoline, Gelatine, Glucose, Glycerin, Glycol, Grease, Helium, Heptane, Hexane, Hexyl Alcohol, Hydraulic Oil, Hydrazine, Hydrobromic Acid, Hydrobromic Acid, Hydrochloric Acid, Hydrocyanic Acid, Hydrofluoric Acid, Hydrogen Gas, Hydrogen Peroxide, Hydroquinone, Iodine, Iso Octane, Isobutyl Alcohol, Isopropanol, Isopropyl Acetate, Isopropyl Chloride, Isopropyl Ether, JP 3 MIL-J5624, JP 4 MIL-J5624, JP 5 MIL-J5624, JP 6 MIL-J5624, Kerosene, Lacquer Solvents, Lacquers, Lard, Lindol, Linoleic Acid, Linsed Oil, Liquefied Petroleum Gas, Lubricating Oils, Lye, Malathion, Maleic Acid, Mercuric Chloride, Mercury, Methane, Methanol, Methyl Acetate, Methyl Acrylate, Methyl Alcohol, Methyl Bromide, Methyl Butyl Ketone, Methyl Cellosolve, Methyl Chloride, Methyl Ether, Methyl Ethyl Kertone, Methyl Isobutyl Ketone, Methyl Mercaptan, Methyl Methacrylate, Methyl Oleate, Methyl Propyl Salicylate, Methylacrylic Acid, Methylene Chloride, MIL-F-25558 (RJ-1), MIL-F-25656, MIL-G-25760, MIL-H-5606, MIL-H-7083, MIL-J5624 Milk, MIL-L-25681, MIL-R-25576 (RP-1), MIL-S-3136, MIL-S-81087, Mineral Oils, Type 1 Fuel, Monovinyl Acetate, Naphtha, Naphthalene, Naphthalenic, Natural Gas, Neatsfoot Oil, N-Hexaldehyde, Nitric Acid, Nitrobenzene, Nitroethane, Nitrogen Tetroxide, Nitrogen Gas, Nitromethane, Nitropropane, N-Octane, N-Pentane, Octyl Alcohol, Oleic Acid, Oleum, Oronite 8200, Oxalic Acid, Oxygen at 200-400 F, Cold Oxygen, Ozone, Peanut Oil, Petroleum Oil, Phenol, Phenylhydrazine, Phosphoric Acid, Phosphoric Trichloride, Pine Oil, Potassium Nitrate, Potassium Sulfate, Producer Gas, Propane, Propanol, Propyl Acetate, Propyl Alcohol, Propylene, Propylene Oxide, Pydraul, Pyranol, Pyrogard, Transformer Oil, Radiation, Rapeseed Oil, Red Oil, RJ-1 (MIL-F-25558), RP-1 (MIL-R-25576), Sea Water, Silicone Grease, Silicone Oils, Silver Nitrate, Skydrol 500, Sodium Bicarbonate, Sodium Carbonate, Sodium Chloride, Sodium Hydroxide, Soyabean Oil, Steam to 350 F, Stearic Acid, Stoddard Solvent, Styrene Monomer, Sucrose Solutions, Sulfur Chloride, Sulfur Dioxide Gas, Sulfur Hexafluoride, Sulfur Trioxide, Sulfur Acid, Sulfurous Acid, Tannic Acid, Tataric Acid, Tertiary Butyl Alcohol, Tertiary Butyl Mercaptan, Tetrabromoethane, Tetrabutyl Titanate, Tetrachloroethane, Tetrachloroethylene, Tetraethyl Lead, Tetrahydrofuran, Tetralin, Toluene, Transmission Fluid, Triethanolamine, Turbine Oil, Turpentine, Varnish, Vinegar, VV-H-910, Wagner 21B Brake Fluid, Water, Whisky and White Pine Tar.

9. The cleaning apparatus according to claim 1, wherein the geometrical configuration of said first tip is different than the geometrical configuration of said second tip.

10. The cleaning apparatus according to claim 1, wherein at least one of said first and second tips includes a series of bristles which form a brush-like tip.

11. The cleaning apparatus according to claim 10, wherein said bristles of said brush-like tip are selected from the group consisting of: nylon, polyester, polypropylene, Teflon, stainless steel wire, carbon steel wire, brass wire, nickel silver wire bronze wire, union fiber mix, tampico, boars hair and horse hair.

12. The cleaning apparatus according to claim 1, wherein at least one of said first and second tips is selectively detachable from its respective first and second end.

13. The cleaning apparatus according to claim 12, wherein said at least one of said selectively detachable tips is selectively interchangeable with an additional tip having at least one of a different geometrical configuration, different porosity, different abrasiveness and amount of bristles.

* * * * *